United States Patent [19]

Nagai et al.

[11] 4,132,548

[45] Jan. 2, 1979

[54] PROCESS FOR REPRODUCING IMAGES OF FINE LINES OR CHARACTERS OF LOW DENSITY

[75] Inventors: Koji Nagai, Itami; Haruki Iwatsuki, Toyokawa; Sanji Inagaki; Hiromi Kameda, both of Itami, all of Japan

[73] Assignee: Minolta Camera Kabushiki Kaisha, Osaka, Japan

[21] Appl. No.: 816,165

[22] Filed: Jul. 15, 1977

[30] Foreign Application Priority Data

Aug. 20, 1976 [JP] Japan ..... 51/100001

[51] Int. Cl.[2] ..... G03G 13/044

[52] U.S. Cl. ..... 96/1 TE; 96/1 LY; 427/16; 118/644; 355/10

[58] Field of Search ..... 96/1 TE, 1 LY; 427/16, 427/17

[56] References Cited

U.S. PATENT DOCUMENTS

| | | | |
|---|---|---|---|
| 3,147,679 | 9/1964 | Schaffert | 96/1 TE |
| 3,598,579 | 8/1971 | Robinson | 96/1 TE |
| 3,672,930 | 6/1972 | Trachtenberg et al. | 427/16 |
| 3,817,748 | 6/1974 | Whitaker | 96/1 LY X |
| 3,951,653 | 4/1976 | Matsumoto | 96/1 LY X |
| 4,050,806 | 9/1977 | Miyakawa et al. | 96/1 LY X |

FOREIGN PATENT DOCUMENTS

| | | | |
|---|---|---|---|
| 2105278 | 8/1971 | Fed. Rep. of Germany | 96/1 LY |
| 873080 | 7/1961 | United Kingdom | 96/1 LY |
| 1214155 | 12/1970 | United Kingdom | 96/1 LY |

*Primary Examiner*—Roland E. Martin, Jr.

*Attorney, Agent, or Firm*—Watson, Cole, Grindle & Watson

[57] ABSTRACT

In a process for reproducing images of fine lines of characters of low density, the latent image is initially transferred onto transfer paper such that charges, including the non-image portions of the original, are transferred onto substantially the entire area of the transfer paper so as to assure transfer of fine images and subsequently developing the transfer paper by a wet-type developing technique such that the transfer paper is passed through at least one electrode effective region having a greater potential than the potential of the non-image portion and a polarity the same as the potential of the areal image of the non-image portions, and also passing the transfer paper through at least one electrode non-effective region to clearly visualize only the latent image with the images of low densities.

11 Claims, 4 Drawing Figures

PROCESS FOR REPRODUCING IMAGES OF FINE LINES OR CHARACTERS OF LOW DENSITY

BACKGROUND OF THE INVENTION

The present invention relates to a process for reproducing images of fine lines or characters in an electrostatic latent image transfer system, and more particularly to a process for reproducing images of fine lines or characters of low density which includes the steps of latent image transfer by electrostatic latent image transfer techniques and image development by wet type liquid developing techniques.

While various processes for transferring electrostatic latent images have been proposed in the past, such prior art processes may roughly be classified into two categories, namely, the transfer by an electrically grounded system and the transfer by application of a biasing voltage.

As a representative example of transfer by an electrically grounded type system, there is the process shown in Japanese Patent Publication SHO42-19757 published on Oct. 4, 1967. The process disclosed in that patent publication comprises, inter alia, the step of bringing a transfer paper, consisting of a dielectric layer coated over an electrically conductive layer into close contact with the surface of a photosensitive member on which an electrostatic latent image is formed. In this step, the transfer paper is brought into intimate contact with the surface of the photosensitive member and with relatively large pressure applied from the rear face of the paper so as to essentially provide no air gap between both surfaces. With essentially no air gap, the transfer of the latent image onto the transfer paper is enhanced by electrically grounding the base of the photosensitive member and the electrically conductive layer of the paper through an electroconductive roller.

Another example of image transfer by an electrically grounded system is U.S. Pat. No. 3,666,458 which discloses the process wherein the transfer of a latent image onto transfer paper is carried out by bringing the paper into virtual contact with the surface of the photosensitive member without application of any pressure; and by grounding the paper and the photosensitive member with the virtual contact maintained.

Another example of the former process is also described in U.S. Pat. No. 3,824,012 assigned to the same Assignee as this patent application. In this process which is illustrated in FIG. 1, an electrostatic latent image corresponding to an original 0 is formed on the surface of photosensitive member 1 in a well-known manner. That is, photosensitive member 1 is uniformly charged by corona charger 2 and subsequently exposed by exposure lamps 9 through mirrors 3, 4 and lens 5. Transfer paper P is in the form of a roll and consists of a high resistance dielectric layer (with a resistivity greater than $10^{13}$ Ω/cm) coated over a high resistance conductive lining layer (with a resistivity in the range of about $10^5$ to $10^{10}$ Ω/cm) and is initially brought into contact with the surface of photosensitive member 1, bearing the latent image, by an insulator member 6 in the form of a sheet. Insulator member 6 may also be in the form of a roll. Insulator member 6 is electrically insulated to have higher resistance than the conductive lining layer of the paper. Then paper P is passed between electrically grounded conductive roller 7, having a lower resistance than the conductive lining layer of the paper, and photosensitive member 1. A small air gap (normally at least 10 microns) is maintained between the surfaces of photosensitive member 1 and paper P to complete the transfer of the latent image onto the transfer paper P. More specifically, in this process, no strong electric field is generated between the transfer paper and the latent image during the approach of the paper onto the latent image as the electrical potential of the conductive lining layer of the paper positioned at insulator member 6 rises in accordance with the potential of the latent image. This effectively prevents the premature transfer of the latent image which is an inherent shortcoming in any of the latent image transfer processes. Thus, with this process, the transfer of the latent image is expedited within the range limited by the resistivities of insulator member 6 and grounded conductive roller 7 so that the high potential portion of the image is transferred during the passage of the paper about insulator member 6, with the transfer of the low potential portion of the image following thereafter being effected by grounded conductive roller 7.

Among the latent image transfer processes using electrically grounded systems described above, the last process described is most effective if a photosensitive member having comparatively large electrostatic capacity and which can be charged to relatively high potential is used. An example of such a photosensitive member comprises a photoconductive layer mixture of Se and As (or Se alone) having a thickness of less than about 1 micron disposed over a conductive base, with a polyvinylcarbazole layer of about 20 microns thick disposed over the photoconductive layer. The high potential charging is obtained because the charging of polyvinylcarbazole is as high as 50 to 70 volts per micron, which is about twice as high as a conventional single-layered Se photosensitive member. Accordingly, such a photosensitive member may then be made capable of accepting a high charge potential, which is necessary in the grounded transfer process, with the polyvinylcarbazole layer thickness as thin as about 20 microns. Thus, with an over-all thin thickness of the photosensitive member, its electrostatic capacity may be retained high to effect satisfactory transfer of the latent image, as may be well understood from the equation: $Q = C\,V$, wherein $Q$ represents the amount of charge to be transferred, $C$ the electrostatic capacity, and $V$ the transfer potential.

However, if a single layered photosensitive member consisting of Se or a mixture of Se with As or Te is to be used in the grounded transfer process, the thickness of the photosensitive member should preferably be made thicker in view of the low charging retention characteristic of selenium, although this will cause the electrostatic capacity to become low. Accordingly, while such a photosensitive member may be used in the grounded transfer process by improving other characteristics contributing to the transfer of the latent image, such as the electrostatic capacity of the transfer paper, it is best to use such a photosensitive member in the transfer process in conjunction with a bias voltage application system as shown in U.S. Pat. No. 3,147,679, in which the image transfer is effected by the application of a biasing voltage to either the photosensitive member or the image transfer means.

To examine the reproducibility of an image corresponding to the original, experiments were conducted on some of the above described exemplary processes. The results obtained show that while such processes reproduce comparatively satisfactory copying images, the following disadvantageous phenomena were observed. Images of low density, particularly images of fine lines and/or characters of relatively low density in the original were not reproduced hardly at all. Foggy areal images not seen in the original were visualized on various parts of the transfer paper. Also, when fine images of low density were reproduced the foggy areal images were also visualized. Herein, the term "images of fine lines or characters", which corresponds to the low density portion of the original having such images, means fine images of low transfer potential. This definition should be regarded as applicable also to such terms as "images of fine lines or characters of low density", "fine images", "fine lines", "fine characters" or "line images" whenever used herein. Examples of fine images, i.e., images of fine lines or characters of low density are the slender lines often drawn in industrial or mechanical drawings which have thin thickness and low depth of color, or any characters or pictures of low densities represented by lines, particularly by lines of low density. The causes for these disadvantageous phenomena will be described hereinafter and there is a need to solve the problems caused by such phenomena.

OBJECTS AND SUMMARY OF THE INVENTION

It is accordingly a primary object of the present invention to provide an improved process for reproducing images of fine lines or characters in an electrostatic latent image transfer system.

It is another object of the present invention to provide a process for reproducing fine images of low density and low transfer potential without causing a fogging phenomenon in an electrostatic latent image transfer system.

It is still another object of the present invention to provide a process for reproducing images of high contrast in an electrostatic latent image transfer system.

It has been found that the aforesaid and other related objects of the present invention may be attained by a process which comprises the steps of electrostatic latent image transfer and image development by a wet-type liquid developing technique.

For a more complete understanding of the nature and objects of the present invention, reference is made to the following detailed description taken in conjunction with the accompanying drawings.

DESCRIPTION OF THE PREFERRED EMBODIMENTS

Figure 1:
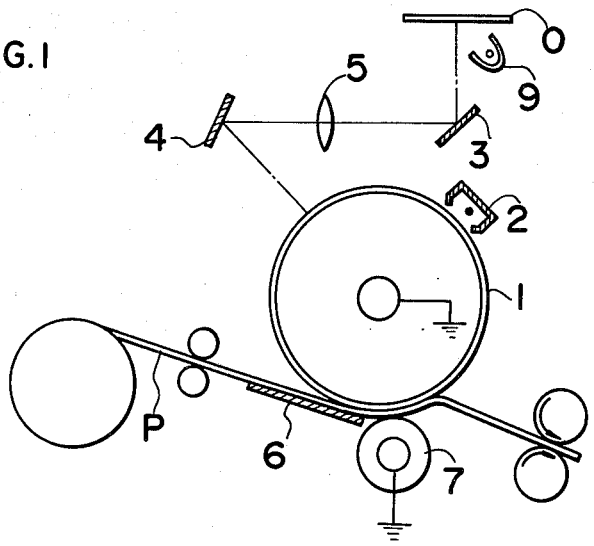
FIG. 1 is a schematic diagram showing conventional electrostatic latent image transfer apparatus for transferring electrostatic latent images, which may be used in the process of the present invention.
Figure 2:
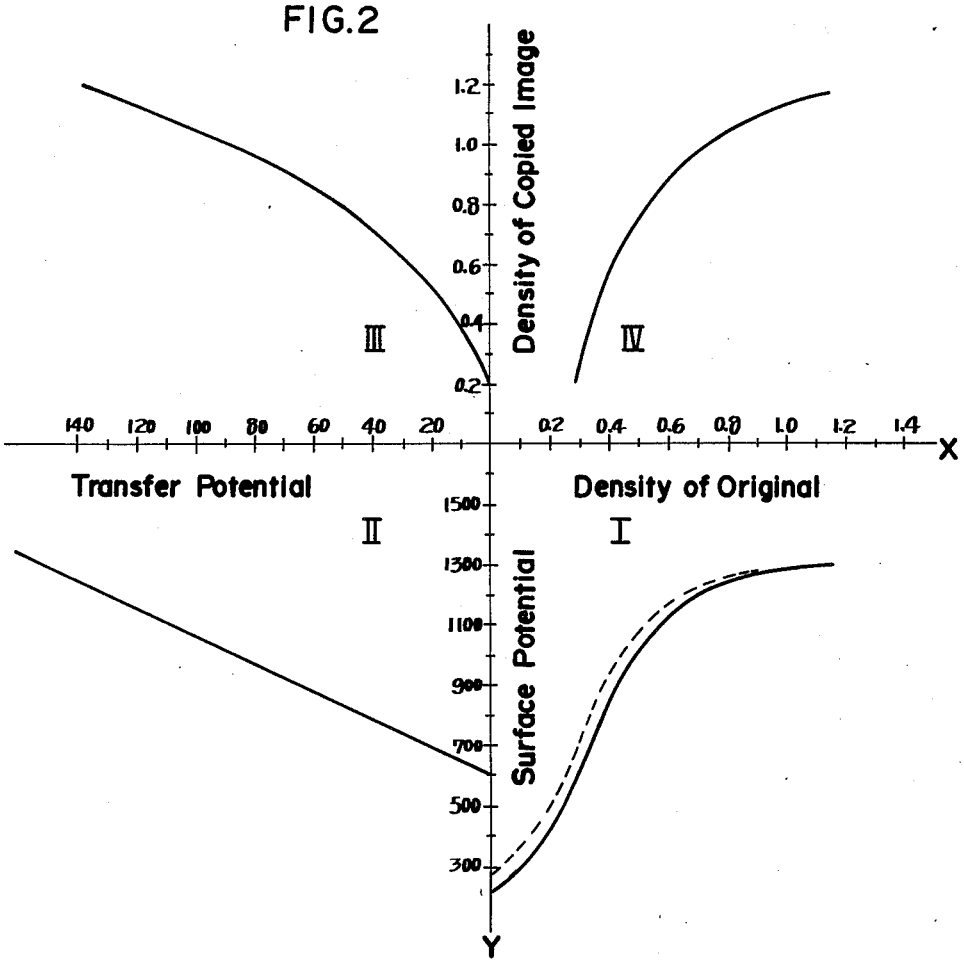
FIG. 2 is a quadrant drawing showing the general characteristics of latent image transfer according to the system of FIG. 1.

Initially, the characteristics of a latent image transfer mechanism utilizing the process illustrated in FIG. 1 will be described with reference to FIG. 2 to analyze the aforesaid disadvantageous phenomena, i.e., the causes for images of fine lines or characters not being reproduced. In FIG. 2, the first quadrant I shows the light decay characteristic of a particular photosensitive member in which the X axis represents the range of density of images on the original and the Y axis represents the surface potentials of the photosensitive member. A dual-layered photosensitive member consisting of an Se-As layer of 0.3 microns disposed over a conductive base and a polyvinylcarbazole layer of 20 microns thick disposed over the photoconductive Se-As layer was used. Utilizing that photosensitive member, the light decay curve shown in quadrant I was obtained by charging the surface of the polyvinylcarbazole layer to a potential of 1300 volts and subsequently exposing the original with an exposure of 18 lux-sec. The reason why the exposure was set to 18 lux-sec. is because of the theoretical consideration that the transfer potential of the non-image portions on the transfer paper is substantially zero for the transfer of the latent image onto the transfer paper, as is more fully described hereinafter.

The second quadrant II of FIG. 2 shows the critical transfer voltage characteristic in which the X axis represents the transfer potential, which is the potential transferred onto the transfer paper, and the Y axis represents the surface potential of the photosensitive member. As is explained in U.S. Pat. No. 3,147,679 or in the book titled "Electrophotography" by R. M. Schaffert (published by The Focal Press, 1966), the critical transfer voltage as determined by Paschen's Law is dependent on various factors such as the electrostatic capacities of the transfer paper and the photosensitive member. In the process carried out by the structure of FIG. 1 in which the transfer of the latent image is conducted by a gaseous discharge phenomenon, that is by conducting charges across an air gap of about 10 microns (for further details of such a process reference is made to U.S. Pat. No. 3,824,012), the critical transfer voltage is 600 volts, provided that the electrostatic capacity of the transfer paper is 300 pF/cm$^2$ and the photosensitive member described above is used. As is shown in quadrant II, this would indicate that a potential of less than 600 volts on the photosensitive member will not be transferred onto the transfer paper, and the curve shows that surface potentials of greater than 600 volts are transferred onto the transfer paper with the transferred potential on the transfer paper being in the range of from 0 to greater than 140 volts.

The third quadrant III shows the relationship between the transfer potential (X-axis) and the density of the reproduced copy image (Y-axis). Finally, the fourth quadrant IV shows the relationship between the original image density (X-axis) and the reproduced copy image density (Y-axis). It should be noted that the densities of the original image and the reproduced copy image are measured by a light reflective method using the "RD-100R Densitometer 4mm" manufactured by Macbeth Co. This method utilizes the principle that a density of zero means that the measured surface is perfectly solid white and reflects light 100% and the density increases as the light reflection decreases. FIG. 2 should be read in the following manner: for example, an original image density of 0.6 corresponds to a surface potential of 1100 volts (the first quadrant I), a transfer potential of 110 volts (the second quadrant II) and this corresponds to a reproduced copy image density of about 1. (the third quadrant III), which in turn corresponds to an original image density of 0.6 (the fourth quadrant IV).

From the results shown in FIG. 2, the following conclusions may be drawn: (1) The reproducibility range of the image is narrow in view of the critical transfer voltage, as images corresponding to an original image density of less than about 0.3 are not reproduced as seen in the fourth quadrant IV; (2) a transfer potential of only a few volts, or even less, is visible because development using a particular type of developer liquid (which will be explained hereinafter) will develop a low transfer potential by the process of FIG. 1 (as well as by other processes) which is as low as 0 to 150 volts; (3) the transferred and developed image is accompanied by substantially no fogging as surface potentials less than the critical transfer voltage are not transferred onto the transfer paper; and (4) as a result, the tone reproducing curve in the fourth quadrant IV shows a rapid rise, particularly in the low density range.

The above described process has an advantage in that an image of comparatively high contrast without fogging may be obtained. But, there is a disadvantage that the image corresponding to the low density portion of the original is not reproduced. Stated differently, this means that the transfer potential of the non-image portion which is attributive to the visualization of fogging and the transfer potential corresponding to the low density portion of the original image, such as fine images, are substantially similar or close. Accordingly, the problem is encountered that in order to visualize the low density fine images, the background also is reproduced as fog.

Figure 3:
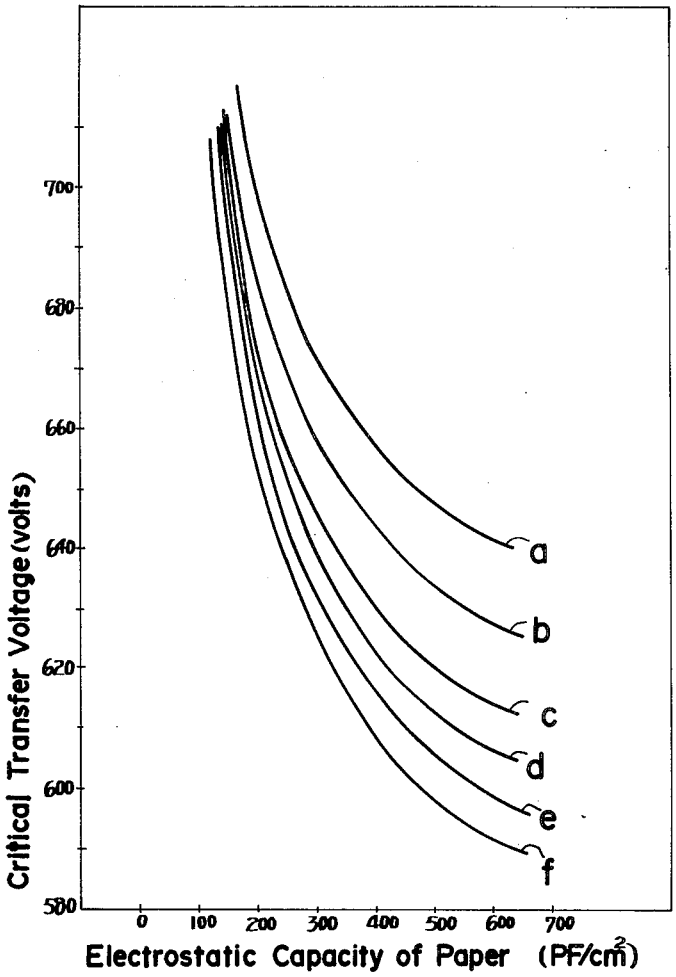
FIG. 3 is a graph showing the relationships of critical transfer voltage and electrostatic capacity of the transfer paper for a number of photosensitive members each having different electrostatic capacities.

However, in actual practice, the image range that is transferred varies in accordance with the fluctuation of the critical transfer voltage caused by small changes such as non-uniformity in the thickness of the photosensitive member and variations in the electrostatic capacity of the transfer paper. FIG. 3 shows how the fluctuation of the critical transfer voltage is affected by the changes in the electrostatic capacity Ct of the transfer paper and in the electrostatic capacity Cs of the photosensitive member. In FIG. 3, the vertical axis represents the critical transfer voltage V, and the horizontal axis represents the electrostatic capacity of the transfer paper. Each of the six curves represents the relationship between the critical transfer voltage and the electrostatic capacity of the transfer paper for six different photosensitive members of the same type but each having a different thickness (i.e., different electrostatic capacity Cs). The photosensitive members are of the above described dual-layered type. The curves represent the aforesaid relationship for photosensitive members having respective electrostatic capacities and total thicknesses (excluding the conductive base) of: in curve *a*, 111pF/cm$^2$ and 24 microns; in curve *b*, 121 pF/cm$^2$ and 22 microns; curve *c*, 133 pF/cm$^2$ and 20 microns; in curve *d*, 140 pF/cm$^2$ and 19 microns; in curve *e*, 148 pF/cm$^2$ and 18 microns; and in curve *f*, 157 pF/cm$^2$ and 17 microns. The results shown in FIG. 3 were derived from theoretical calculations and not from actual observations. While the actual observation of the critical transfer voltage was 600 volts using a photosensitive member having an electrostatic capacity of 133 pF/cm$^2$ and a thickness of 20 microns, and a transfer paper having a capacity of 300 pF/cm$^2$, the theoretical calculation indicates that the critical transfer voltage is about 645 volts as obtained from FIG. 3. In any event, FIG. 3 apparently shows that even a small unevenness in the thickness of photosensitive member or in the electrostatic capacity of the transfer paper, or a variation in both parameters causes a fluctuation of the critical transfer voltage. Consequently, a non-uniformity in the reproduced copy image will result as the image potentials on the photosensitive member surface which are close to, or similar to, the critical transfer voltage are either transferred or not transferred from time-to-time.

Unevennesses or non-uniformity in the light exposure or the charging by the corona charger onto the photosensitive member, as well as other factors, similarly cause variations in the image range transferred to bring about non-uniformity in the reproduced copy image. This uneven image caused by the fluctuation of the critical transfer voltage as well as by the other factors explained above, apparently means that either the fine images are not reproduced or when reproduced, foggy areal images are visible on the reproduced copies.

Manufacture of the photosensitive member and transfer paper with sufficiently matched electrostatic capacities and the necessary corrections of non-uniformity in exposure and charging are not practically attainable to avoid the afore-described formation of uneven images. However, there is a way to avoid the visualization of foggy areal images, namely, by increasing the amount of exposure. While such an increase in the amount of exposure effectively lowers the potentials of the non-image portions of the electrostatic latent image formed on the photosensitive member and prevents the transfer of such potentials onto the paper, it also causes the fine images to be erased as the potentials corresponding to the fine images are similar to, or close to, the potentials of the foggy areal images. Accordingly, increasing the exposure is not a correct solution. Another attempt to solve such a problem is the application of a bias voltage to the photosensitive member or the image transfer means in an attempt to effectively lower the critical transfer voltage. But even then, the visualization of foggy areal images cannot be prevented although it will enhance the reproduction of fine images of low density.

Accordingly, the reproduction of fine images, such as line images which correspond to low density portions of the original, must be sacrificed to obtain a clear and high contrast reproduced image in the electrostatic latent image transfer system. However, the resolution, or the sharp contrast of the reproduced image has to be sacrificed in order to reproduce the fine images.

The present invention is directed to solving the problems and disadvantages heretofore described by providing a process for reproducing an original image using electrostatic latent image transfer techniques wherein images of fine lines or characters of low density are reproduced without causing fogging. Specifically, the present invention basically includes two steps for reproducing fine images wherein the latent images representing both the fine images and the foggy areal images are transferred onto the transfer paper in the first step and then the fine images are reproduced with erasure of the transferred foggy areal images, that is without causing them to be visible.

Describing first the first step of the present process, it is apparent that in order to reproduce the fine images of the low density portions of the original, the fine images themselves must naturally be transferred onto the transfer paper. However, there arises a problem in that the foggy areal images are also transferred onto the transferred paper as the potentials corresponding to the foggy areal images are similar or close to the potentials of the fine images. As has been described in connection with FIG. 2, such fine images correspond to the low density portions of the original having densities of less than or about 0.3, and such images formed as latent images on the photosensitive member would have potentials in the range close to the critical transfer voltage of about 600 volts. Accordingly, the range of potentials for the fine images are similar to the potentials of the background area (foggy areal image). Thus, the transfer of the fine images onto the transfer paper cause at least some charges on the background area to be transferred. The present invention recognizes this problem, but yet transfers both the fine images and foggy areal images onto the transfer paper in a manner such that the potentials (charges) are transferred onto the entire area of the non-image portions of the transfer paper corresponding to the non-image portions of the original to be copied. Specifically, this may be accomplished either by stopping-down the amount of exposure from its normal amount during the formation of the latent image on the photosensitive member, or by applying a suitable bias voltage to the photosensitive member or to the image transfer means. Various other suitable methods, some of which are described hereinafter, may also be used to effect reliable transfer of the low potentials corresponding to the fine images.

With respect to the transfer of fine images by the adjustment of the amount of the exposure, the amount of exposure on the photosensitive member for formation of the latent image is such that the potential of the non-image portion (i.e. background area) decays to a certain specific value by its exposure and is set to substantially prevent the transfer of the non-image portion potentials onto the transfer paper. But actually, the charges making up the non-image portion and the fine images are partially transferred or not transferred in accordance with the fluctuation of the critical transfer voltage, or by the non-uniformity in the exposure or charging steps as noted above. To overcome that problem, the stopping-down of the amount of exposure, i.e., the decrease of the exposure amount, has the same effect as if the light decay curve in the first quadrant of FIG. 2 is shifted substantially parallelly leftwards in accordance with the amount of the stopped-down exposure. Stated differently, this has the same effect as if the value of the critical transfer voltage were lowered. Accordingly, a relatively high potential remains on the non-image portion of the photosensitive member. While that causes the formation of fogging, the transfer of the fine images of low density having potentials similar to the potentials of the non-image portions are assured. Then, both the foggy images and the fine images are transferred without being dependent on the fluctuation of the critical transfer voltage or by exposure and charging non-uniformities.

In the experiments conducted, the results obtained showed that the transfer potential of the non-image portion transferred to the transfer paper was substantially zero by the application of an exposure of 18 lux-second on the afore-described dual layer photosensitive member consisting of a photoconductive Se-As layer and a polyvinylcarbazole layer. However, the transfer potential of the non-image portion resulted in a range of about 1 to 7 volts with the exposure stopped-down to 16 lux-sec. The phantom light decay curve in the first quadrant of FIG. 2 shows this result and indicates that potentials close to the critical transfer voltage are effectively transferred. This apparently means that there is a potential of at least 1 volt on the entire area of the non-image portion of the transfer paper although non-uniformities in the transfer potential are present. This in effect ensures that the latent images of the fine lines or characters of low density which are similar to the potential of the non-image portion are transferred onto the transfer paper. Accordingly, no partial foggy areal images transferred by the non-uniformity in the exposure and charging steps, or by the fluctuation of the critical transfer voltage are formed on the transfer paper. Instead, an areal image of the non-image portions which fogs over an entire area of the non-image portions are formed on the transfer paper. That is to say that at least some charges are transferred to the entire area of the transfer paper and in this manner, the transfer of low potential corresponding to the fine image onto the transfer paper is assured. The image that fogs over entire areas of the non-image portions on the transfer paper are referred to hereinafter as the non-image portions of the areal image.

Further experiments were conducted on a single-layered photosensitive member consisting of a selenium layer 50 micron thick disposed on a conductive base and which was charged to a surface potential of about 1100 volts and having a critical transfer voltage of 660 volts. The results obtained showed the transfer potential of the non-image portions to be zero at an exposure of 4.9 lux-sec. And a transfer potential of 1 to 8 volts was transferred onto the entire non-image area by stopping-down the exposure to 4.4 lux-sec. Such stopped-down exposures are sufficient to assure transfer of the fine images onto the transfer paper and for other forms or types of photosensitive members. The necessary stopped-down exposure may easily be determined empirically by experiments.

The stopping-down adjustment of the exposure to enable the transfer of low potential corresponding to the fine images of low density, may be accomplished by any suitable means. One example of such means is an electrical circuit system which lowers the intensity of illumination for exposing an original to be copied. Specifically, a switch for "light original", that is, an original with fine images of low density, may be provided in an electrophotographic copying apparatus. With the actuation of that switch, the voltage applied to the exposure lamps is lowered so that the amount of light reaching the photosensitive member is less.

Figure 4:
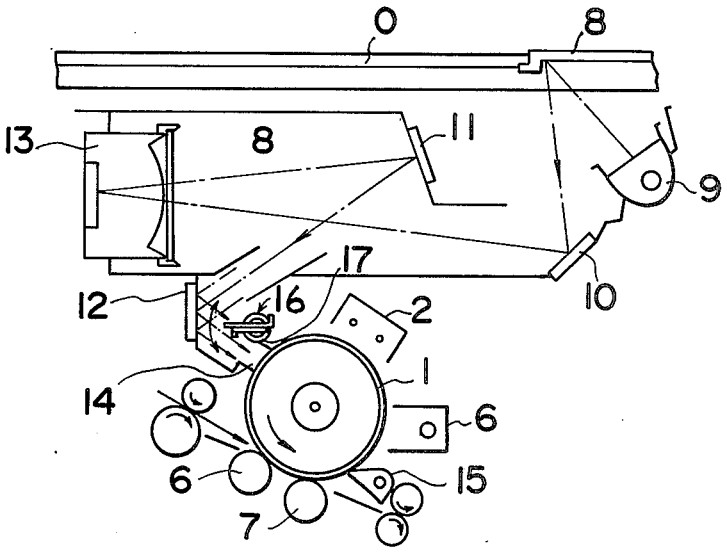
FIG. 4 is a sectional view of electrophotographic copying apparatus utilizing a slit control device useful for the process of the present invention.
Figure 5:
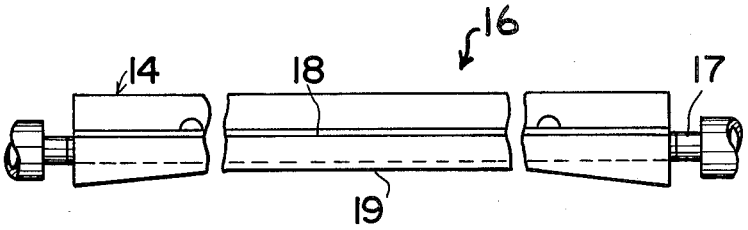
FIG. 5 is a front plan view of the slit control device of FIG. 4.

Another example of means for stopping-down the exposure is a device which adjusts the slit width of the optical path through which the exposed optical image passes as shown in FIGS. 4 and 5. In FIG. 4, which shows the essential part of an electrophotographic copying apparatus employing such a device, original 0 is placed on a reciprocatingly movable table 8 and the image thereof is projected onto a rotatable photosensitive member 1 by exposure from lamps 9 via mirrors 10, 11, 12 and the mirror lens 13 as the table 8 moves. A corona charger 2, an exposure slit 14, an image transfer means, including an insulator member 6 and a grounded conductive roller 7, the function of which has been described in connection with FIG. 1, are arranged around the periphery of photosensitive member 1. A paper separating means 15 and erasing means 16 are sequentially provided in the rotational direction of photosensitive member 1. At the exposure slit 14, slit control device 16 adjusts the width of the slit to effect the stopping-down of the exposure. As shown in detail in FIG. 5, slit control device 16 includes shaft 17 pivotally supported parallel to the axis of photosensitive member 1. Principal blade 18, having a rectangular plate-like configuration, is supported on shaft 17 with the front and rear edges of blade 18 parallel to shaft 17. The front edge of blade 18 is located to cut into the path of the projected optical image by the rotation of shaft 17. Auxiliary blade 19 is fixedly mounted on shaft 17 at right angles to principal blade 18 with the front edge thereof having a central portion formed generally parallel to the edge of blade 18 but having its opposite end portions gradually extending outwardly to form a slit width adjusting portion thereat. Shaft 17 may be rotated by any suitable means from the outside of the apparatus. When it is desired that less exposure of the photosensitive member is needed, shaft 17 may be rotated counterclockwise so that the width of the exposure slit is narrowed only by principal blade 18. However, when more light is required, shaft 17 may be rotated clockwise to control the slit width by auxiliary blade 19 alone, or together with principal blade 18. The control of the slit width then effectively controls the exposure of photosensitive member 1, and accordingly, charges corresponding to the non-image portions are also transferred by lowering the exposure of photosensitive member 1 by adjusting the slit width. Thus, the areal image of the non-image portions is transferred onto the transfer paper to assure the transfer of fine lines or characters. By the use of such a slit control device, the power supplied to exposure lamps 9 may be kept constant, or alternatively the power may be varied to control the exposure intensity together with the slit control device. Also, the slit control device referred to above is not limited to such a specific embodiment and in particular, the principal and auxiliary blades may be any suitable shapes.

Additionally, the stopping-down adjustments of the exposure referred to above may be accomplished by other methods as well to obtain the same effect. One such method is to raise the initial surface potential of photosensitive member 1 with the exposure intensity maintained constant. Specifically, in the case of the electrostatic latent image transfer process referred to in FIG. 1 and which utilizes the afore-described dual-layered photosensitive member, the surface charging of photosensitive member 1 by corona charger 2 may be raised to a potential of 1350 volts from 1300 volts. Another method is the use of a neutral density filter (ND filter) adjacent lens 5 of FIG. 1, and such a filter should have a light transmission of about 92% or less to stop-down the exposure from 18 lux-sec. for the dual-layered photosensitive member described above. Yet another method is the application of a suitable amount of biasing voltage to photosensitive member 1 or grounded conductive roller 7 of FIG. 1. Normally, the application of about 50 volts for the process of FIG. 1 permits about 10 volts of transfer potential to be transferred onto the non-image portions of the transfer paper. Finally, other exemplary methods are to manufacture the photosensitive member with a thicker over-all thickness, or to manufacture the transfer paper with a greater electrostatic capacity. Either one of those methods has the effect of lowering the critical transfer voltage as is apparent from a consideration of FIG. 3. In each of the methods described above, the transfer of potential onto the non-image portions of the transfer paper is effected to assure the transfer of potential corresponding to a fine image having low densities.

Thus, in the first step according to the process of the present invention, the fine images such as images of fine lines and characters of low densities, are positively transferred onto the transfer paper although there is a disadvantage in that the potentials of the non-image portions are also transferred onto the entire area of the non-image portions of the transfer paper. The potentials of the fine images transferred onto the transfer paper are normally in the range of greater than zero volts (but not zero volts) but less than about 30 volts, although such a range may vary depending upon the means used to transfer the fine images and various other conditions. Usually, transfer potentials of a few volts maximum for fine images will be sufficient since a potential of even less than 1 volt is developed to become visualized as shown in the third quadrant of FIG. 2. But the potential range for fine images varies depending upon the stopped-down exposure type of photosensitive member used, etc. The transferred potentials on the areal image of the non-image portion accordingly has a range similar to the potential range of the fine images, although its maximum potential may be higher or lower than the maximum potential of the fine images.

While the transfer paper, having transferred thereon the electrostatic latent image of the original as well as the areal image of the non-image portions, is subject to liquid development in the next step to visualize the image, no clear image can be obtained as the areal image of the non-image portions are also visualized unless measures are taken to prevent such visualization of the areal image. The present invention, in the second step described hereinbelow, reproduces only the fine images (as well as images having a higher potential than the fine images) without visualizing the areal image of the non-image portions. More specifically, the development step of the invention utilizes the edge effects phenomenon which is inherent in the liquid development process, and also the application of a reverse biasing voltage having the same polarity as the polarity of the latent image for the developing electrodes.

To explain the second step in detail, it is necessary to understand that in order to visualize only the fine images, the potentials corresponding to the fine images must be applified, whereas the potentials corresponding to the non-image portions of the areal images must be erased or not amplified during the development process. In this connection, a developing process with relatively precise developing efficiency is required as the latent image formed on the transfer paper by the electrostatic latent image transfer process has a relatively low range of potentials from about 0 to 150 volts as may be seen from the results shown in FIG. 2. This, in other words, means that the developing process capable of generating a strong electric field between the transfer paper bearing the latent image and the developing electrode is necessary to obtain a developed latent image of high contrast and high density.

Figure 6:
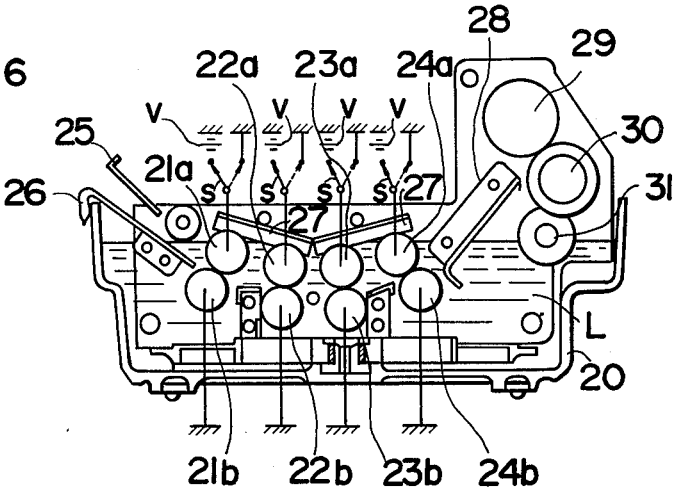
FIG. 6 is a cross-sectional view of wet-type developing apparatus suitable for use in the process of the present invention.

As an example of a suitable developing process, that is, as an example of a developing process which will visualize only the fine images (and the images of higher potentials) and develop a latent image having low potential to high density, it was discovered that the wet-type developing apparatus shown in FIG. 6 is found to be most suitable. In FIG. 6, the developing apparatus includes reservoir 20 containing therein a suitable amount of developer liquid L including toner particles. The toner particles have a polarity opposite to the polarity of the latent image, and, for example, if the latent image is constituted by negative charges, the toner has a positive polarity. In reservoir 20, plural pairs of electrode rollers 21*a*, 21*b*, 22*a*, 22*b*, 23*a*, 23*b*, 24*a*, 24*b* are rotatably mounted in spaced relation to form a path for the transfer paper bearing the latent image. The electrode rollers are made of conductive material such as metal and each pair of rollers are essentially in contact with one another with the upper electrode rollers 21*a*, 22*a*, 23*a*, 24*a* mounted to maintain a gap of about 100 microns or less between the latent image and the upper electrode rollers during the passage of the transfer paper between each pair of rollers. Electrical power sources V are connected through switches S to each of upper electrode rollers 21*a*, 22*a*, 23*a*, 24*a*, under which the latent image bearing surface side of the transfer paper passes to apply a voltage of the same polarity as the latent image to each of the upper electrode rollers. The amount of voltage to be applied to these rollers depends on various factors such as the process utilized to transfer the latent image, but it should be at least greater than the maximum potential of the aforedescribed areal image of the non-image portions as will be further discussed hereinafter. Each of switches S may be switched over to another contact connected to ground, and it is preferred that rollers 21*a*, 22*a*, 23*a*, 24*a* be connected to ground through switches S when the transfer paper is not present to prevent short-circuiting between the upper and lower electrode rollers. Accordingly, switches S should preferably be switched-over to sequentially connect the upper electrode rollers to power sources V as the transfer paper is transported through the rollers. Such a switching operation may be carried out by any of the known means involving sensing of the transfer paper within the developer apparatus, such means being known to the art and not requiring additional description herein for the purpose of carrying out the invention. It should additionally be noted that lower electrode rollers 21*b*, 22*b*, 23*b*, 24*b* are respectively electrically grounded through the main frame or body of the developing apparatus.

The developing apparatus shown in FIG. 6 includes a pair of guide plates 25, 26 for guiding the transfer paper into the developing apparatus, cleaning means 27 made of soft cloth in contact with the upper electrode rollers 21*a*, 22*a*, 23*a*, 24*a* for cleaning the rollers, another guide plate 28 for guiding the transfer paper out of the apparatus, and a pair of squeeze rollers 29, 30 with cleaner roller 31 in contact with one of the squeeze rollers for squeezing excess developer liquid from the transfer paper. With respect to the developer liquid L in reservoir 20, the toner used therein must have a light absorptivity higher than the toner used for an electrofax system, as the potential of the transferred latent image is comparatively lower. The term light absorptivity of the toner is defined by the equation, log Io/I, wherein Io is the intensity or amount of light directed on the toner, and I is the intensity or amount of light transmitted through the toner. A toner suited for the process of the present invention has a light absorptivity in the range of about 15 to 35 as compared with a light absorptivity of about 5 for the toner used in an electrofax system. Also, the charging capacity of the developer liquid used is defined as one-half of the total amount of the charging body (toner) in the developer liquid, and it is preferable that the charging capacity be within the range of about 0.2 to 6 micro-coulomb/$cm^3$, which is comparatively lower than that of the developer liquid used for an electrofax system.

In the developing process based upon the aforedescribed developing apparatus, the development of the image is effectively expedited in spite of the low latent image potential due to the generation of a strong electric field between the transfer paper bearing the latent image and the electrode roller as a result of their close disposition with respect to each other during the development process. According to comparative experiments conducted with a developing process using the saucer type electrode system, as is normally most often used in an electrofax type copier wherein the development is effected with a relatively large gap of a few millimeters between the latent image surface and the saucer type electrode, it was determined that the generation of an electric field of about 10 to 100 times stronger than the saucer type electrode system existed between the latent image bearing surface and the electrode roller in the process of FIG. 6. Thus, the developing process exemplified in FIG. 6 guarantees the development of the latent image to a high density.

To experimentally determine if this developing process is suitable for visualizing a latent image including fine images of low potential without visualizing the areal image of the non-image portions of low potential, it was discovered that this developing process effects the development of the areal image of the non-image portions and the latent image having fine images in the following manner. As may be apparent from the developing apparatus shown in FIG. 6, the latent image formed on the transfer paper is transported by each pair of electrode rollers 21*a*, 21*b*, 22*a*, 22*b*, 23*a*, 23*b*, 24*a*, 24*b* through regions where the electrode effects are present (hereinafter electrode effective regions, such regions being between the upper and lower electrode rollers) and through other regions where no electrode effects are present (hereinafter electrode non-effective regions, such other regions being between each pair of electrode rollers, before the first pair of electrode rollers, and after the last pair of electrode rollers). In this regard, the experiments on the developing efficiency in the electrode effective regions and the electrode non-effective regions were conducted by using a transfer paper formed with both areal images of the non-image portions and the fine images having the same potential.

Figure 7:
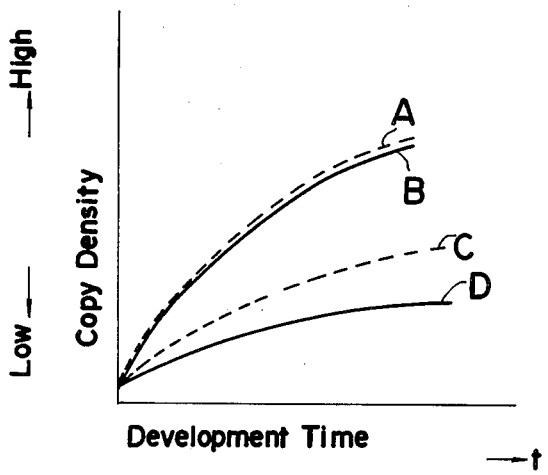
FIG. 7 is a graph showing the development characteristics for fine images and areal images of non-image portions for conditions where electrode effects are present and conditions where electrode effects are not present.

The results obtained by the above experiments are shown in FIG. 7 wherein the vertical and horizontal axes respectively represent the reproduced copy density and development time. Also in FIG. 7, chain line A represents the development characteristic or efficiency for the fine images (images of fine lines or characters of low density) in the electrode effective regions, which are the regions between each pair of the upper and lower electrode rollers. Solid curve B represents the development characteristic of the areal image of the non-image portions in the electrode effective regions. Chain line C and solid line D respectively represent the development characteristics of the fine images and the areal image of the non-image portions in the electrode non-effective regions, which are the regions between each pair of electrode rollers, the entrance side of the first pair, and the exit side of the last pair of rollers. The results shown in FIG. 7 indicate that while both the fine images and the areal image of the non-image portions are visualized to have substantially the same copy density in the electrode effective regions as the development progresses, a relatively large difference in the copy density between the fine images and the areal image of the non-image portions is caused in the electrode non-effective regions, as is evident from the curves C and D. Specifically, the fine images are developed to have relatively high copy density as the development progresses, whereas the copy density of the areal image of the non-image portions hardly increases in the electrode non-effective regions. This difference in copy density is believed to be primarily caused by what is known as the edge effect phenomenon, which is inherent in liquid development. With such a phenomenon, the fine images, that is in particular the images of fine lines, are amplified to be visualized to a high density.

However, the different copy density evident in the electrode non-effective regions would be visually developed to substantially the same copy density in the electrode effective regions as shown by the curves A and B. Accordingly, in order to visualize only the fine line or character images of low potential (and images of higher potential) without visualizing the areal image of the non-image portions (such image being caused by charges on the background area having a potential substantially the same potential as the fine images), it is necessary on the one hand to maintain the density difference, caused in the electrode non-effective regions, even in the electrode effective regions during the passage of the transfer paper; and to complete the development before the elapse of that time which causes the areal image of the non-image portions to be visualized.

From the foregoing discussion and observations, it is necessary to prevent enhancement of the development of the fine image and the areal image of the non-image portions during the passage of the latent image through the electrode effective regions. That is, in the development process in the electrode effective regions it is necessary to avoid any influences of the electrode effect from acting on the fine image and the areal image of the non-image portions. Based upon that consideration, the present invention applies a potential, at least corresponding to the potentials of the fine image and the areal image of the non-image portions, which potentials are substantially equal to one another and of the same polarity as the latent image, to upper electrode rollers 21*a*, 22*a*, 23*a*, 24*a* at the time of passage of the latent image formed on the transfer paper. Stated differently, the present invention applies a potential at least as large as the maximum potential of the areal image of the non-image portions to the upper electrode rollers. Specifically, by connecting power source V to apply a biasing voltage of at least the same or greater magnitude than the maximum potential of the areal image of the non-image portions to the respective upper electrode rollers 21*a*, 22*a*, 23*a*, 24*a* through switches S, the transfer paper having thereon the transferred fine images (as well as the images of higher densities) and the areal image of the non-image portions in the aforedescribed first step are developed to visualize only the fine images by the edge effect phenomena when the transfer paper passes through the electrode non-effective regions in the developing apparatus. When the transfer paper next passes through the electrode effective region, a biasing voltage corresponding at least to the maximum transfer potential of the areal image of the non-image portions is applied to the respective upper electrode rollers. Thereby, the development of the areal image of the non-image portions as well as the fine images having potentials lower than the biasing potential are prevented. It is apparent that the latent images having higher potentials than the biasing potential are developed during the development process.

Figure 8:
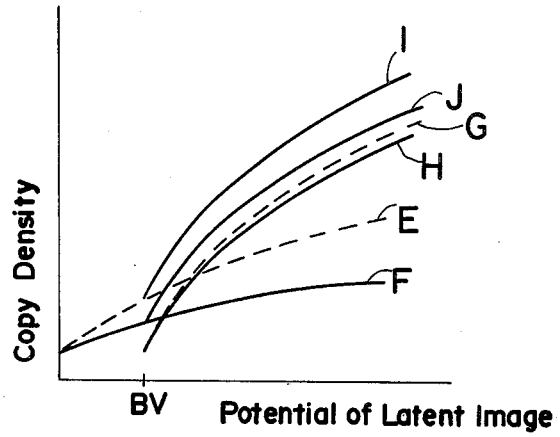
FIG. 8 is a graph in accordance with the present invention related to the graph of FIG. 7 in which the development characteristics of reproduced copy images having fine images of low density are shown.

The following is a detailed explanation of the development characteristics in accordance with the aforedescribed second step with reference made to FIG. 8. The vertical and horizontal axes of FIG. 8 respectively represent the copy density of the reproduced image and the transferred potential of the latent image on the transfer paper. It should be noted that the latent image formed on the transfer paper in accordance with the first step should be regarded as having fine images with potentials at least greater than the maximum potential of the areal image of the non-image portions, as well as the fine images with low potentials less than the maximum potential of the areal image of the non-image portions, and areal images having potentials at least greater than the areal image of the non-image portions, as well as the areal image of the non-image portions with substantially similar potentials as the fine images. In FIG. 8, curves E and F respectively represent the development characteristics of the fine images and the areal images in the electrode non-effective regions. Curves E and F respectively correspond essentially to the curves C and D shown in FIG. 7. Additionally, curves G and H respectively represent the development characteristics of the fine images and the areal images in the electrode effective regions with an applied biasing potential at least as great as the maximum potential of the areal image of the non-image portions. Finally, the curves I and J respectively represent the total development characteristics of the fine images and the areal images, wherein curve I is the sum of curves E and G and curve J is the sum of curves F and H.

If a biasing potential BV, corresponding at least to the maximum potential of the areal image of the non-image portions, is applied to respective upper electrode rollers 21*a*, 22*a*, 23*a*, 24*a* from power sources V through switches S when the transfer paper passes through each pair of electrode rollers as shown in FIG. 6, the development of images having lower potentials than the biasing potential BV, that is the development of the fine images and the areal image of the non-image portions, are prevented and only the images having higher potentials than the biasing potential are developed as is apparent from curves G and H shown in FIG. 8. However, the development of fine images, particularly the fine images having low potentials lower than biasing potential BV are enhanced by the edge effects, without the areal image of the non-image portions hardly becoming visible as shown by curves E and F when the transfer paper passes through the electrode effective region. Accordingly, the developed image obtained has a high and clear contrast with the fine images clearly reproduced, but without any fogging.

However, there is one more condition that should be included in the second step. If the development time in the electrode non-effective regions is too long, the development characteristic of the areal image of the non-image portions would rise as the time elapses and it will be developed to have a visible copy density. Accordingly, there is a need to establish development times for development in the electrode non-effective regions. For this purpose, the positions of the respective pairs of electrode rollers in the developing apparatus of FIG. 6 are suitably rearranged to vary the total amount of distance in the electrode non-effective regions. Specifically, four apparatus similar to that of FIG. 6 were assembled with the total distance for the electrode non-effective regions set to 5 cm, 10 cm, 20 cm, and 40 cm respectively. Here the total distance for the electrode non-effective regions means the sum of distances between respective pairs of electrode rollers 21*a*, 21*b*; 22*a*, 22*b*; 23*a*, 23*b* and 24*a*, 24*b*; the entrance region preceding the first pair of electrode rollers 21*a*, 21*b* and the exit region following the last pair of electrode rollers 24*a*, 24*b*. *transporting speeds of the transfer paper were adjusted to be* 5 cm/sec. 10 cm/sec. and 20 cm/sec., respectively, in each of the apparatus set forth above to determine the proper development time.

As for the characteristics of the developer liquid L, a charging capacity of 2 microcoulomb/cm$^3$ and a light absorptivity of 20 for the toner was used. The results of experiments conducted with such a developer liquid and toner showed a development time of less than about 2 seconds, and particularly less than about 1 second in the electrode non-effective regions, were satisfactory in obtaining a developed image without visualization of the areal image of the non-image portions. In the experiments conducted with a development time of less than 2 seconds but longer than 1 second, the areal image of the non-image portions was slightly visualized, but the image as a whole was developed to have high contrast with the fine images developed to relatively high density. For a development time of less than 1 second in the electrode non-effective regions, the fine images were reproduced, but no areal image of the non-image portions were reproduced. Further, the image as a whole had quite an excellent contrast with no fogging at all. It was observed that an image obtained with development time of more than 2 seconds in the electrode non-effective regions produced visualization of the areal image of the non-image portions to a relatively high density with poor overall contrast.

The foregoing detailed description represents an exemplary embodiment of the development process wherein a latent image formed on transfer paper is passed through alternate electrode effective regions and electrode non-effective regions. A biasing potential, which prevents the development of fine images and the areal image of the non-image portions, is applied to provide the electrode effective regions. However, the order of passage of the transfer paper through each of the regions is not critical, i.e., the transfer paper may pass through either of the regions first. In addition, the transfer paper need not necessarily pass through each of the two different regions a plurality of times as described with respect to the developing apparatus of FIG. 6, but, for example, may pass through each different region once with the path of each region suitably lengthened. Furthermore, the biasing potential applied to the electrode rollers facing the latent image surface should be of a potential somewhat exceeding the maximum potential of the areal image of the non-image portions. That is, the biasing potential should be the sum of the maximum potential of the areal image of the non-image portions plus an additional potential, as the transfer paper may have excessively high potential transferred thereon due to the microscopic non-uniformity of its surface to assure prevention of the development of the areal image of the non-image portions. Moreover, the biasing potential may additionally be applied to the lower electrode rollers, that is, the electrode rollers facing the opposite surface on which the latent image is formed. Finally, the expression "electrode non-effective region" as used herein does not necessarily mean that such region has no electrode effect at all but is intended to include those regions that may have weak electrode effects.

Figure 9:
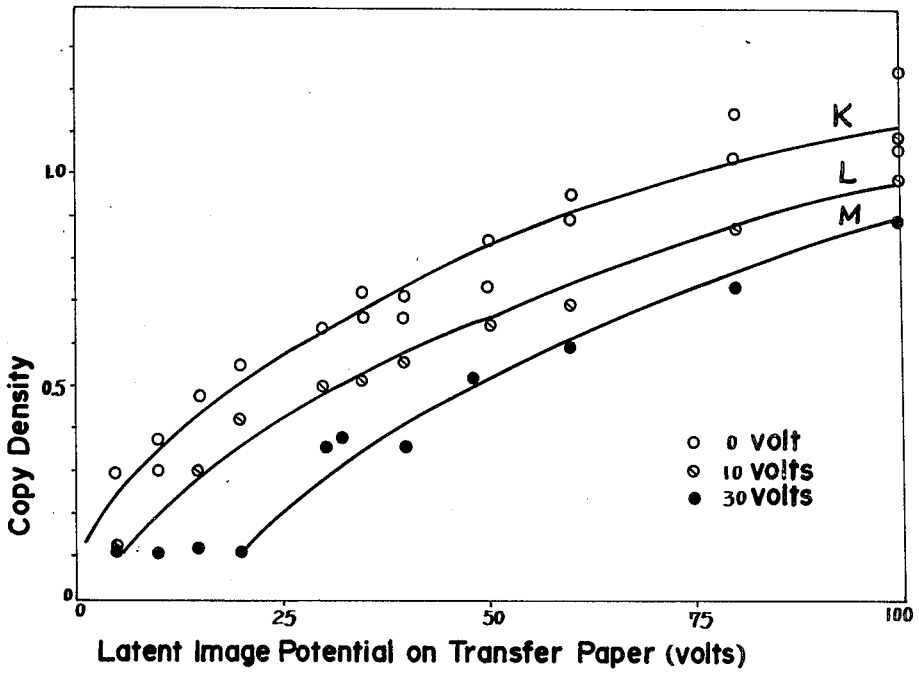
FIG. 9 is a graph showing the development characteristics of the present invention in which the effects of bias voltage application are shown.

Experiments were conducted with the reproduced image obtained in accordance with the first and second steps, the results of which are shown in FIG. 9. The original comprised a sheet of Kodak Gray Scale (sold by Eastman Kodak Co.), which has a plurality of areal images each having a different reflective density in the range from 0.08 (which is close to perfect white) to 1.90 (which is close to perfect black). Graph paper printed with numerous slender lines of low densities running horizontally and vertically at 5 mm intervals was attached adjacent the gray scale sheet. In the experiments, a dual-layered photosensitive member containing 0.3 microns of SE deposited on conductive base and 18 microns of polyvinylcarbazole deposit over the Se layer, was charged uniformly to a potential of 1300 volts and then exposed to the original with an exposure of 16 lux-sec. The latent image formed thereby then was transferred onto a transfer paper, having an electrostatic capacity of 300 pF/cm$^2$, using the electrostatic latent image transfer apparatus shown in FIG. 1. It was noted that potentials in the range of about 1 to 7 volts were formed on the background area, i.e., on the areal image of the non-image portions of the transfer paper. In developing this transfer paper with the developing apparatus of FIG. 6 containing developer liquid having a charging capacity of 2 microcoulomb/cm$^3$ and a toner having an absorptivity of 20, the upper electrode rollers 21*a*, 22*a*, 23*a*, 24*a* were all electrically grounded with no biasing potential applied thereto. The results obtained are represented by the symbols 0 and the development characteristic curve K in FIG. 9. As is apparent from curve K, about 5 volts areal image of the non-image portions was developed to a copy density as high as 0.3 and the areal image was clearly visible as fog. Thus, while the application of no biasing potential resulted in the visualization of the latent image over a relatively wide range of densities as shown by the curve K, the fog (i.e., the areal image of the non-image portions appeared and the aforementioned lines on the graph paper were also reproduced.

Another transfer paper formed with the same latent image in the same manner described above was developed with a biasing potential of 10 volts applied to the upper electrode rollers 21*a*, 22*a*, 23, 24*a* from power sources V through switches S illustrated in FIG. 6. The results obtained are represented by the symbols 0 through which the development characteristic curve L is drawn. The potential of 5 volts of the areal image of the non-image portions, reproduced to a copy density of 0.3 with no biasing potential applied, was lowered to a copy density of about 0.1 by the application of 10 volts. Since the transfer paper itself has a reflective density of about 0.1, this signifies that no areal image of the non-image portions were visualized at all. However, the fine images of the slender lines were clearly reproduced.

Finally, the same latent image was formed on the transfer paper but with the exposure stopped-down so that potentials in the range of about 1 to 20 volts were present on the areal image of the non-image portions. This transfer paper was then developed with a biasing potential of 30 volts applied to the upper electrode rollers 21a, 22a, 23a, 24a. The data obtained are represented by symbols ●, which form the basis for development characteristic curve M in FIG. 9. Potentials of less than 20 volts were hardly reproduced indicating that a high contrast and a clear image were obtained with the slender lines having low densities reproduced by the edge effects phenomena previously described.

While the experiments were conducted with biasing potentials of 10 and 30 volts, such potentials are all dependent on the potential of the areal image of the non-image portions. However, since the potentials transferred onto the transfer paper are relatively low and since application of high biasing potential would cause the overall copy density range to be reduced, it is preferable that the applied biasing potential be at least about 5 volts, but less than 50 volts or more, and preferably in the range of about 5 to 30 volts.

Although the foregoing invention has been described in some detail by way of illustration and examples for purposes of its understanding, it is understood that certain changes and variations may be practiced within the spirit of the invention as limited only by the scope of the appended claims.

What is claimed is:

1. A process for reproducing an electrostatic latent image of an original formed on a photosensitive member, comprising the steps of:

transferring the electrostatic latent image onto a transfer paper by an electrostatic latent image transfer apparatus and developing said transfer paper with a wet type developing apparatus to obtain a reproduced image;

the step of transferring including the step of transferring charges onto substantially the entire area of the non-image surface portions of the transfer paper corresponding to the non-image portions of the original to assure transfer of images of fine lines and characters of low densities; and said step of developing including passing said transfer paper through at least one electrode effective region and at least one electrode non-effective region with the electrode effective region having a potential greater than the potential of the non-image portion of the transfer paper and a polarity the same as the latent image applied to said portion to prevent development of the images of fine lines and characters and said non-image portions in said at least one electrode effective region and to develop said images of fine lines and characters in said at least one electrode non-effective region, said transfer paper passing through said electrode non-effective region within a time less than two seconds.

2. A process for reproducing images of fine lines of low densities of an original comprising the steps of:

forming an electrostatic latent image of the original on a photosensitive member;

subsequently transferring the latent image onto a transfer paper;

and developing the transfer paper;

the step of transferring including bringing the paper into close contact with the photosensitive member such that charges on the non-image portions of the latent image corresponding to the non-image portions of the original are transferred onto substantially the entire area of the non-image portions of the transfer paper to assure transfer of the images of fine lines having potentials close to the potentials of the non-image portions of the transfer paper;

the step of developing including developing the transfer paper with developer liquid by passing the paper through at least one electrode effective region having a potential at least as large as the maximum potential of the non-image portions of the transfer paper and the same polarity as the applied latent image, and through at least one electrode non-effective region to prevent development of the images of fine lines and said non-image portions at said at least one electrode effective region, and to develop said images of fine lines without visualizing said non-image portions at said at least one electrode non-effective region; and said step of passing the transfer paper through said at least one electrode non-effective region is less than two seconds.

3. The process as in claim 2 wherein the step of forming an electrostatic latent image includes the step of stopping-down the exposure to retain a potential on the non-image portions of the latent image on the photosensitive member sufficient for charge transfer onto the non-image portions of the transfer paper in said step for transferrring the latent image onto the transfer paper.

4. The process as in claim 3 wherein said step of stopping-down the exposure is effected by controlling the intensity of lamp means for exposing the original.

5. The process as in claim 3 wherein said step of stopping-down the exposure is effected by adjusting the width of a slit through which the exposed image passes.

6. The process as in claim 3 wherein said step of stopping-down the exposure is effected by introducing a neutral density filter into the path through which the exposed image passes.

7. The process as in claim 2 further comprising the step of initially uniformly charging the photosensitive member to a high surface potential and the subsequent step of forming the latent image retains a potential on the non-image portions of the latent image on the photosensitive member sufficient for charge transfer onto the non-image portions of the transfer paper in said step for transferring the latent image onto the transfer paper.

8. The process as in claim 2 wherein said step of transferring the latent image onto the transfer paper includes the step of applying a biasing voltage during the transfer of the latent image to effect the transfer of charges onto substantially the entire area of the non-image portions of the transfer paper.

9. The process as in claim 2 wherein said step of passing the transfer paper through said at least one electrode effective region and through said at least one electrode non-effective region is repeated.

10. The process as in claim 2 wherein the potential applied to said at least one electrode effective region is less than about 50 volts but greater than the maximum potential of the non-image portions of the transfer paper.

11. A process for reproducing images of fine lines of low densities of an original, comprising the steps of:

forming an electrostatic latent image of the original on a photosensitive member to retain relatively high potentials on the non-image portions of the latent image of the photosensitive member;

transferring the latent image onto a transfer paper by bringing the paper into close contact with the photosensitive member by an image transfer means such that the charges on the non-image portions of the photosensitive member are transferred onto substantially the entire area of the non-image portions of the transfer paper to assure transfer of the images of fine lines having potentials substantially equal to the potentials of the non-image portions;

developing the transfer paper with developer liquid having a charging capacity in the range of 0.2 to 6 microcoulomb/$cm^3$ and having a toner absorptivity in the range of 15 to 35 and passing the transfer paper through at least one electrode effective region having a potential greater than the maximum potential of the non-image portions of the transfer paper but less than 50 volts and the same polarity as the applied latent image and through at least one electrode non-effective region to prevent development of the images of fine lines and said non-image portions in said at least one electrode effective region and to develop said images of fine lines without visualizing the non-image portions in said at least one electrode non-effective region; and the time required for the paper to pass through said at least one electrode non-effective region is less than about 2 seconds.

* * * * *